US008128355B2

(12) United States Patent
Elsaesser et al.

(10) Patent No.: US 8,128,355 B2
(45) Date of Patent: Mar. 6, 2012

(54) FAN FOR A GAS BURNER SYSTEM

(75) Inventors: Alexander Elsaesser, Villingen-Schwenningen (DE); Anton Breier, Friedberg (DE); Karl-Heinz Glatz, Obereschach (DE)

(73) Assignee: Minebea Co., Ltd., Nagano (JP)

( * ) Notice: Subject to any disclaimer, the term of this patent is extended or adjusted under 35 U.S.C. 154(b) by 1162 days.

(21) Appl. No.: 11/976,973

(22) Filed: Oct. 30, 2007

(65) Prior Publication Data

US 2008/0131283 A1 Jun. 5, 2008

(30) Foreign Application Priority Data

Dec. 4, 2006 (DE) ..... 10 2006 057 086

(51) Int. Cl.
*F04D 29/42* (2006.01)

(52) U.S. Cl. ..... 415/204; 415/212.1

(58) Field of Classification Search ..... 415/204, 415/206, 212.1
See application file for complete search history.

(56) References Cited

U.S. PATENT DOCUMENTS

| | | | | |
|---|---|---|---|---|
| 2,109,742 | A * | 3/1938 | Fanning | 415/119 |
| 4,432,694 | A * | 2/1984 | Kuroda et al. | 415/172.1 |
| 5,040,943 | A * | 8/1991 | Dwyer et al. | 415/26 |
| 6,511,290 | B1 * | 1/2003 | Gatley, Jr. | 415/212.1 |
| 6,575,696 | B1 * | 6/2003 | Lyons et al. | 415/119 |

* cited by examiner

*Primary Examiner* — Richard Edgar
(74) *Attorney, Agent, or Firm* — Duane Morris, LLP

(57) ABSTRACT

A fan for a gas burner system where at the outflow side of the fan a combustion gas is fed in, in order to form a flammable mixture of gas and air, the fan comprising a spiral-shaped fan housing having a rotational axis and an air outlet; the air outlet of the fan housing widening like a snail shell towards the outflow side of the fan; an impeller that is arranged concentric to the rotational axis in the interior of the fan housing; and an electric motor for driving the impeller, which is integrated at the center of the impeller.

15 Claims, 6 Drawing Sheets

Figure 1:
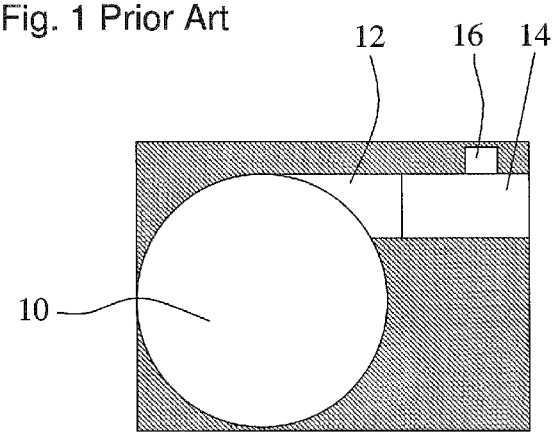
Fig. 1 Prior Art

62
64
50
20
22
24

A–A
24
46
58
B
59
60
26
B

B–B
52
A
48
50
44
22
26
A
24

FAN FOR A GAS BURNER SYSTEM

FIELD OF THE INVENTION

The invention concerns a fan for a gas burner system where at the outflow side of the fan a combustion gas is fed in, in order to form a flammable mixture of gas and air.

BACKGROUND OF THE INVENTION

This kind of fan is known, for example, from EP 1 091 171 A1. This document describes a fan burner that can generate a homogeneous air flow. The fan burner comprises a fan housing having a spiral-shaped channel and an approximately perpendicular deflector making it possible to mount a burner housing at the aperture of the spiral-shaped channel lateral to the fan housing. The burner housing is located on the same side of the fan casing as an external drive for a radial impeller of the fan. Due to the deflector, which is turned towards the side of the electric motor, the burner is seated in the free space above the electric motor of the fan, thus making it possible to minimize the overall size of the device.

U.S. Pat. No. 5,839,891 describes a gas burner having an air blower and a device to feed in combustion gas at the outflow side of the air blower. The air blower itself is made up of a spiral-shaped blower housing having an external drive motor, the aperture of the blower housing extending substantially tangential to the air blower. A somewhat protruding device for generating the combustible gas/air mixture is produced thereby, as can be seen from FIG. 1 of this document.

US 2005/0178344 A1 reveals a fan for a gas burner system in which the aperture of the fan housing is deflected by approximately 90° in a similar way like the first document described above, and directly connected to a hot-water boiler. The fan described in this patent application, is fed directly with combustion gas into the fan housing so that the gas/air mixture is already produced in the fan housing. This holds the risk of a combustible gas being formed in the interior of the fan which could ignite due to electrostatic charges. To prevent the gas/air mixture from igniting, conductive material is to be used in the manufacture of the fan housing. In this context, the US patent application describes that the fan housing is either deep-drawn from metal or alternatively made of plastics. If plastics are used, however, only plastics having anti-static properties should be used for both the fan housing as well as the impeller to prevent ignition of the gas/air mixture.

In common gas burner systems, the two basic options are to add the gas either before or after the fan. If the gas is added before the fan, sealing the fan housing becomes particularly critical in order to prevent any leakage of the combustible gas/air mixture. For other types of fans as well, the same efforts are made to design the housing as airproof as possible to prevent any loss of pressure due to leakage flows.

In common fans for gas burner systems, the drive motor of the impeller is always disposed outside of the fan housing. In this arrangement, the motor shaft that is led into the fan housing has to be sealed gas proof against the housing. In accordance with the prior art where the drive motors of the fans are flexibly supported the seal is particularly crucial. The shaft seal required therefor causes friction that puts load on the drive motor.

In practice, the drive motor is decoupled by means of elastic elements from the housing-half on which it is mounted so as to prevent motor vibrations from being transmitted to the gas burner system and thus to ensure that its operation is as noise-free as possible. This elastic support of the drive motor makes it more difficult to seal the motor shaft and the fan housing.

Further prior art that describes fans for gas burner systems can be found, for example, in DE 100 15 399 A1, DE 44 43 045 A1, GB 304,851 and U.S. Pat. No. 2,456,930.

Based on this prior art, an object of the present invention is to provide a fan for a gas burner system that is compact, that can be variably mounted, that can be manufactured at low cost and that does not entail the risk of the gas/air mixture self-igniting.

SUMMARY OF THE INVENTION

The fan according to the invention comprises a spiral-shaped fan housing having a rotational axis and an air outlet, that widens like a snail shell towards the outflow side of the fan and the aperture of the air outlet lies on a plane that extends in a substantially radial manner to the fan housing. The pressure build-up within the fan housing can be further optimized, for example, in that the opening of the air outlet is raised screw-like from the plane of the fan housing, whereat the air outlet opening having the same radial orientation but no longer lying on the same plane as the impeller. In other words, the air outlet opening is raised with respect to an imaginary plane on which the fan housing lies.

The fan further comprises an impeller that is disposed inside of the fan housing concentric to the rotational axis, and an electric motor to drive the impeller that is disposed at the center of the impeller.

The fan according to the invention is extremely compact and can achieve a space saving of approximately 20% solely by the shape of its fan housing alone compared to known fans for gas burners, as described in more detail below. The design and arrangement of the aperture of the fan housing makes it possible to dispose the downstream device for admitting the combustion gas such that it almost abuts the fan housing in any orientation so desired. By disposing the electric motor to drive the impeller at the center of the impeller, additional space saving in depth of approximately 50% can be achieved. Furthermore, problems involved in the sealing of the shaft and concerning the elastic support of the drive on the fan housing can be avoided or easily solved.

In the preferred embodiment of the invention, the fan housing and the impeller are made of plastics. Most preferably, the fan housing and the impeller are made up of one or more injection molded plastic parts, the use of anti-static material being unnecessary. Since the combustion gas is only fed in at the outflow side of the fan, there is no danger of a combustible gas/air mixture being formed in the interior of the fan housing. This not only makes it possible to dispose the drive motor in the interior of the fan housing, but also to make the housing and impeller out of plastics. This means that the fan housing and the impeller neither need to be made of a conductive metal material that is complicated to machine nor need to be made of an anti-static material that is comparatively expensive. In addition, the fan housing need not be sealed gas-proof.

The fan according to the invention may be further simplified by using an impeller that does not have its own impeller cover as the fan housing is constructed so that it forms a stationary cover for the impeller. In another embodiment of the invention, the impeller comprises a synchronously rotating cover that is preferably made of the same material as the impeller, although it may be made of a different material, such as metal.

To reduce or fully eliminate any backflow of the air flow at the back of the impeller, a labyrinth seal can be provided in the region of the outside circumference of the impeller between the impeller and the fan housing according to the invention. The labyrinth seal is preferably disposed on the outside of the synchronously rotating impeller cover, most preferably in the vicinity of its inside circumference. It is expedient to use a labyrinth seal for an impeller having a synchronously rotating impeller cover.

A further simplification of the fan according to the invention can be achieved by pockets to receive balance weights, integrated in the impeller.

It is expedient that the aperture of the fan housing is equipped to be connected to a venturi device for supplying the combustion gas. For example, means for a screwed joint, bayonet connection, clamped joint or any other appropriate means of connection to a venturi device of this kind can be provided at the aperture of the fan housing.

In a preferred embodiment of the invention a damping sleeve is provided between the aperture of the fan housing and the venturi device, the damping sleeve fixing the fan housing to the venturi device and dampening the transmission of vibrations. Furthermore, a drain opening can be provided in the air outlet channel for a reference pressure.

In a further preferred embodiment of the invention, the electric motor is fully encapsulated against environmental influences by being molded in, for example.

SHORT DESCRIPTION OF DRAWINGS

Figure 2:
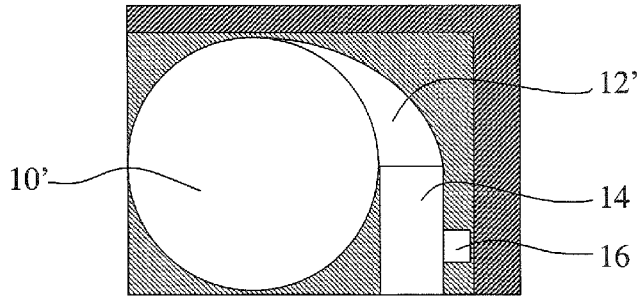
Figure 3:
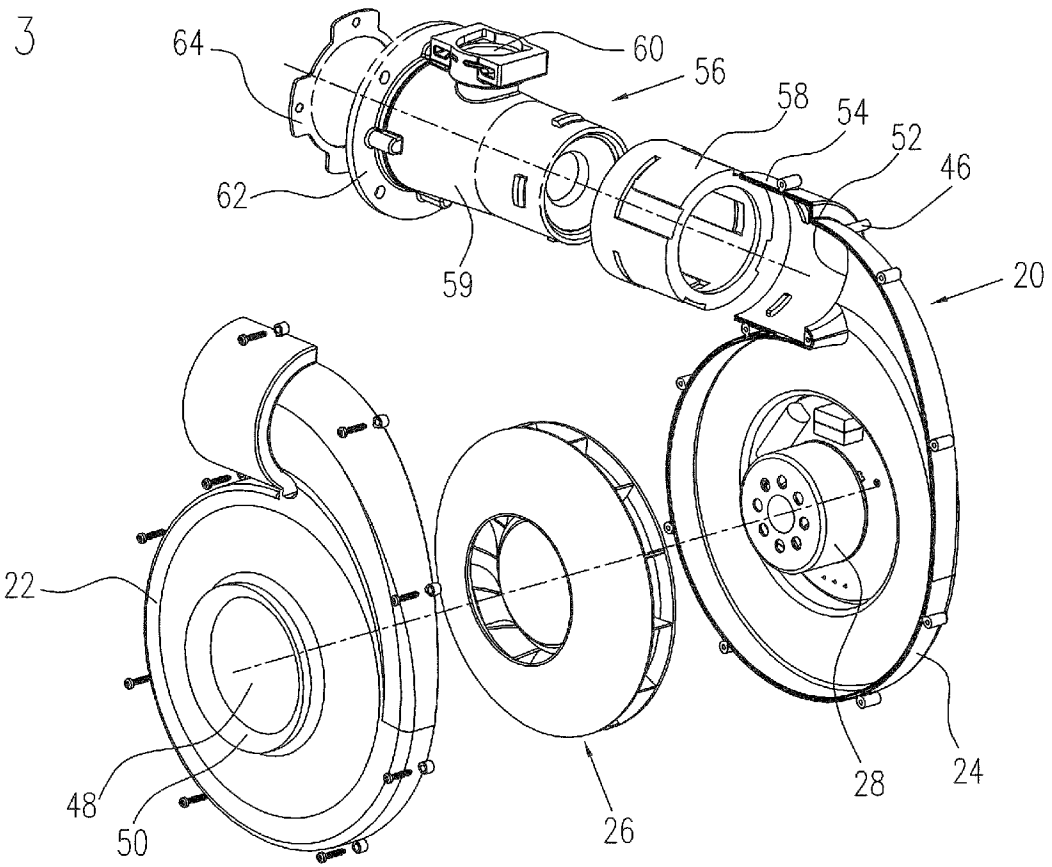
Figures 4, 5, 6:
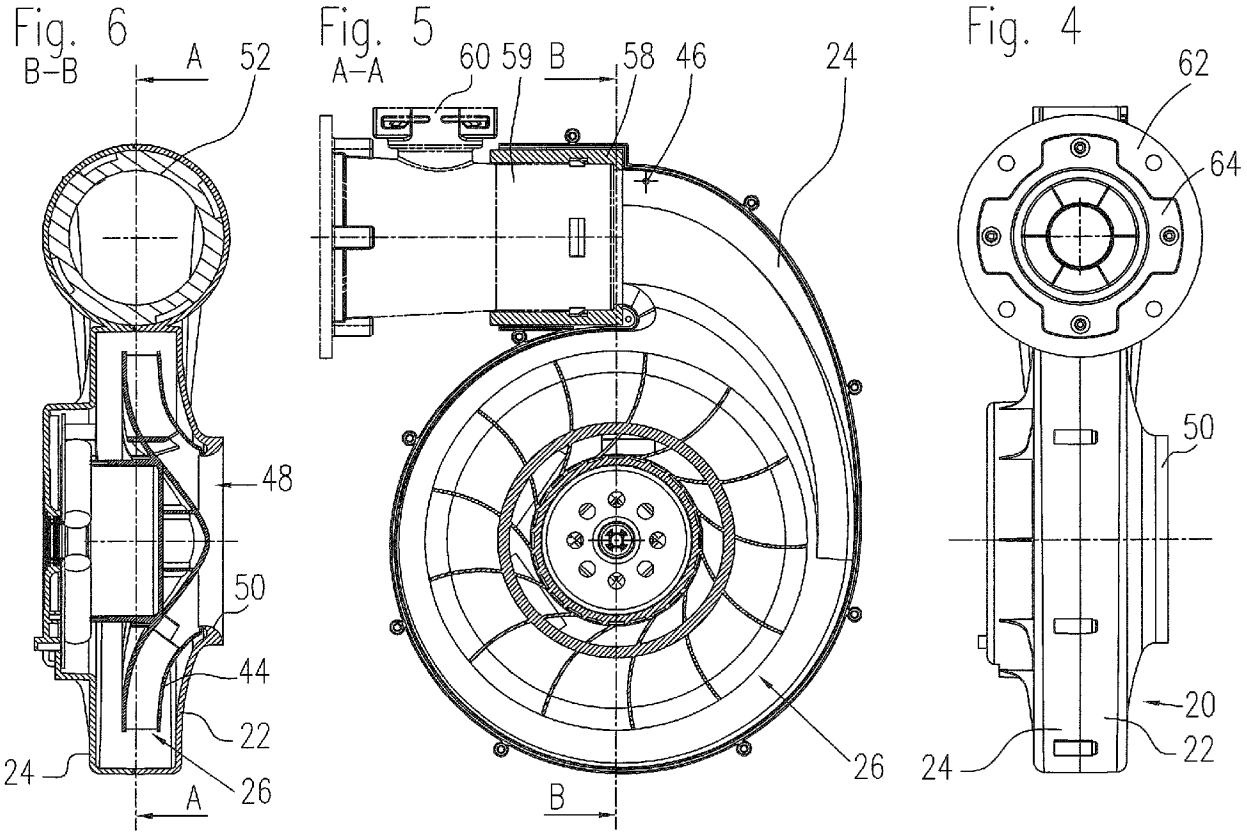
Figure 7:
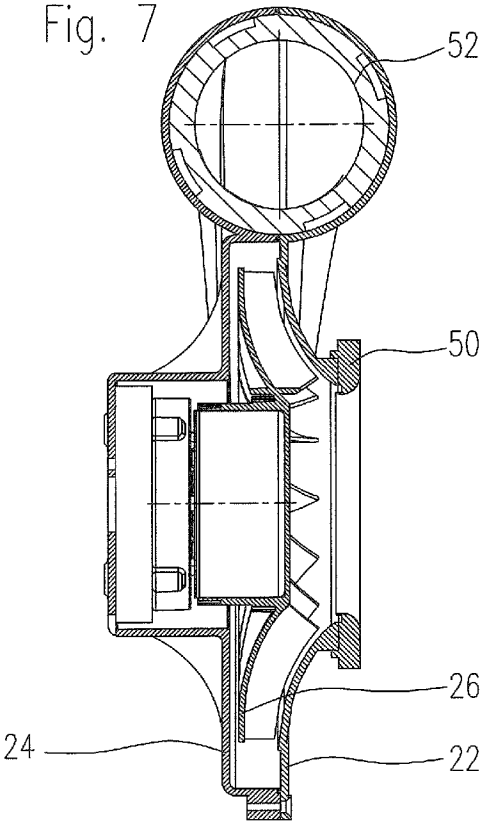
Figure 8:
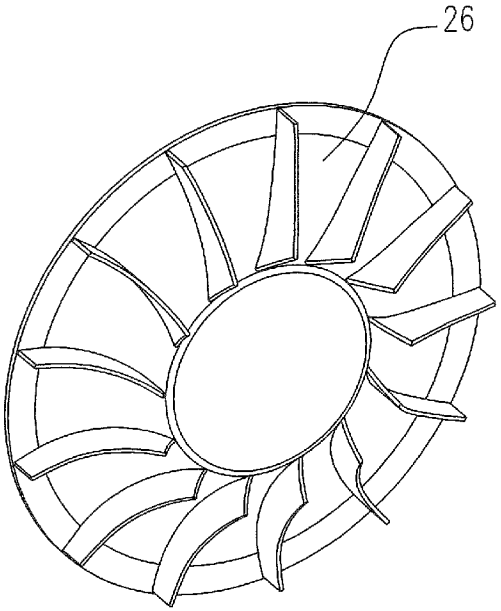
Figure 9:
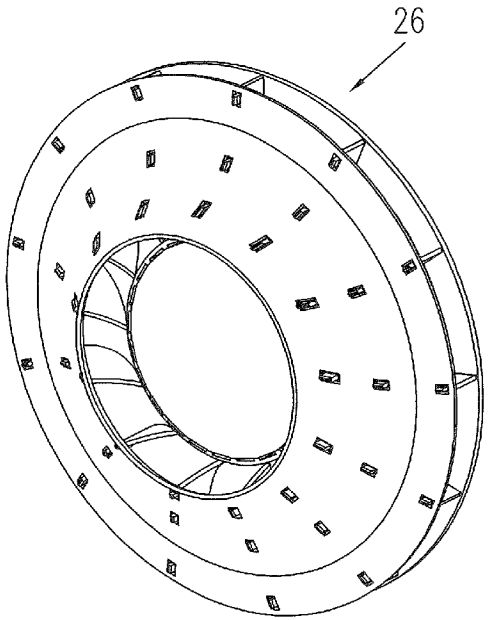
Figure 10:
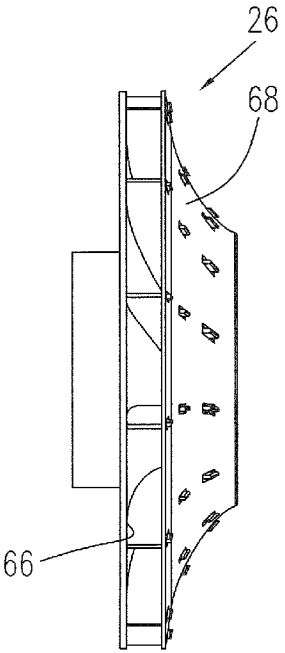
Figure 11:
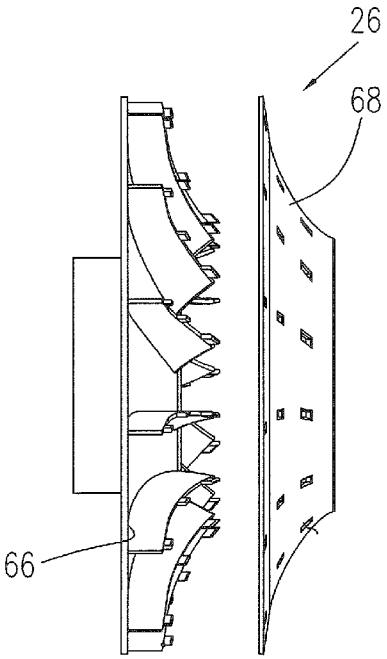
Figure 12:
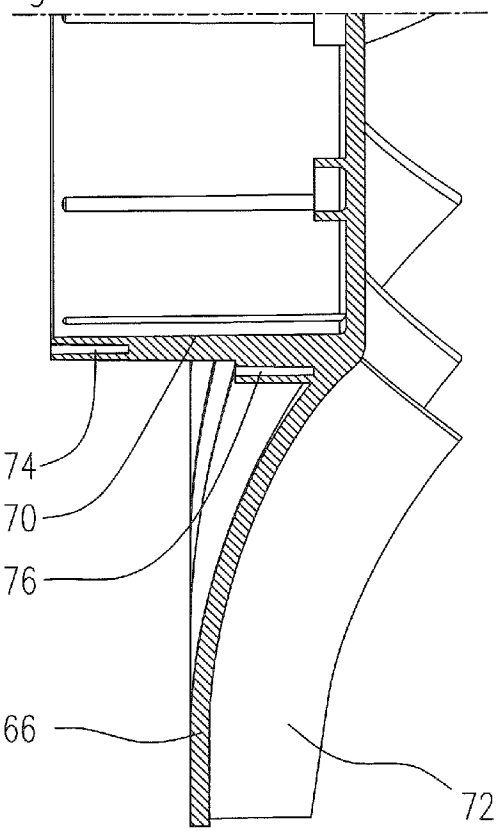
Figure 13:
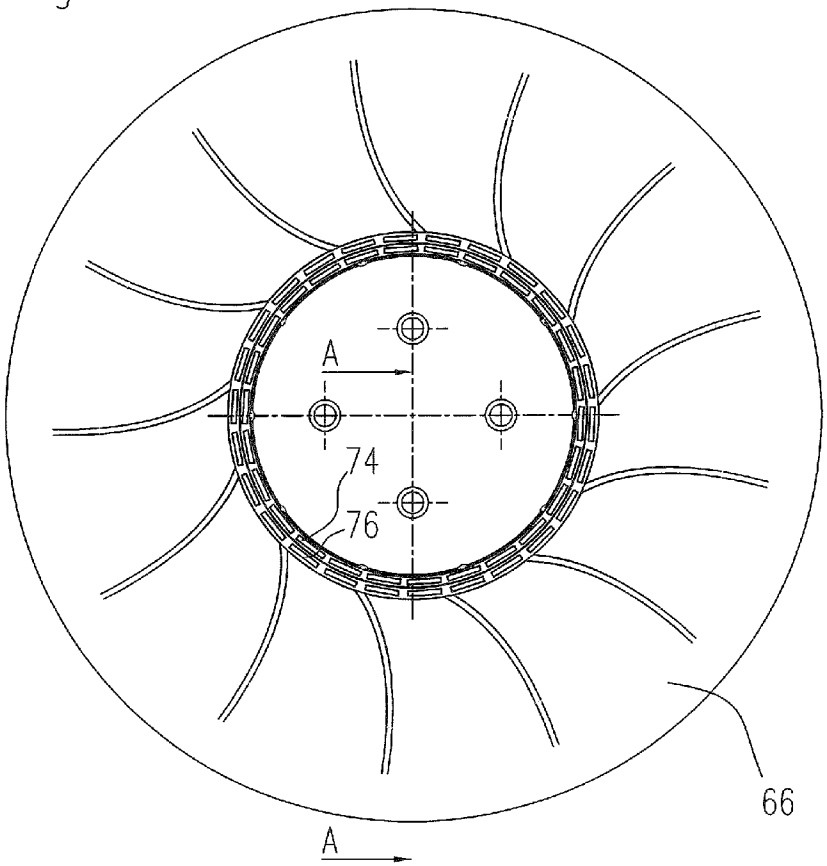

The invention is described in more detail below on the basis of the preferred embodiments with reference to the drawings. The figures show:

FIG. 1 a schematic view of a fan for a gas burner system according to the prior art;

FIG. 2 a schematic view of the fan for a gas burner system according to the invention;

FIG. 3 an perspective exploded drawing of a fan for a gas burner system according to a first embodiment of the invention;

FIG. 4 a front view of the fan of FIG. 3;

FIG. 5 a sectional view through the fan of FIG. 4 along the line A-A;

FIG. 6 a sectional view through the fan of FIG. 5 along the line B-B;

FIG. 7 a similar view as in FIG. 6 according to a second embodiment of the invention;

FIG. 8 a perspective top view of the impeller that is used in the second embodiment of the invention;

FIG. 9 a perspective view of the impeller according to another embodiment of the fan presented in the invention;

FIG. 10 a side elevation of the impeller of FIG. 9;

FIG. 11 an exploded view of the impeller of FIG. 9;

FIG. 12 a partial sectional view of the impeller according to the embodiment of FIG. 8; and FIG. 13 a bottom view of the impeller according to the embodiment of FIG. 8.

DETAILED DESCRIPTION OF PREFERRED EMBODIMENT

FIG. 1 schematically shows a fan housing 10 for a gas burner system according to the prior art whose air outlet tube 12 is coupled to a downstream venturi device 14 for the purpose of supplying combustion gas. The air outlet tube 12 extends tangentially away from the fan housing 10, its aperture also is lying on a plane tangential to the fan housing. A similar arrangement is also shown, for example, in the above mentioned U.S. Pat. No. 5,839,891.

FIG. 2 schematically shows a fan for a gas burner system according to the invention that is coupled to an identical venturi device. In FIG. 2, the fan is represented by a fan housing 10 having an air outlet tube 12'. According to the invention, the air outlet tube 12' of the fan housing 10 widens like a snail shell towards the outflow side of the fan, the aperture of the air outlet tube 12' lying on a plane that extends in a substantially radial manner to the fan housing 10. This makes it possible to dispose the venturi device 14 in a way that it more or less abuts the circumference of the fan housing 10. The resulting space saving for the system consisting of the fan and the venturi device is approximately 20%, this space saving being achieved independently of the arrangement of the drive motor for the fan. A further space saving of approximately 50% in depth compared to the fans of the prior art is achieved by integrating the motor within the impeller. To optimize the pressure build-up, the air outlet opening can further be raised vis-a-vis the plane on which the impeller lies in the way of a stretched spiral. The air outlet opening has the same orientation as before, but no longer lies on the same level as the impeller.

The motor integrated in the impeller can be encapsulated against environmental influences so as to protect it against any corrosive substances which might be deposited in the fan housing. For these purposes, the stationary parts of the motor could be injection molded, for example, with plastics.

In practice, the venturi device 14, together with the gas valve 16 for supplying combustion gas, is fixedly connected to a burner (not illustrated). As can be seen from FIG. 2, the fan according to the invention has a very compact design, wherein it can be very easily coupled to the venturi device 14 using, for example, a rubber flange, without requiring any further mechanical connection to the burner. This also makes it possible to largely prevent the transmission of any vibrations to the burner thus producing a gas burner system having low noise development.

FIG. 3 shows the fan according to the invention in conjunction with a venturi device in an exploded view showing further details. The fan comprises a spiral-shaped fan housing 20 that is made out of two housing halves 22, 24. The two housing halves 22, 24 can be joined together using screws, for example. In the interior of the fan housing 20, there is an impeller 26 at whose center an electric drive motor 28 is disposed. The motor 28 may be designed as an outer rotor motor or an inner rotor motor or as a disk rotor motor, the design of the motor itself not being a subject matter of the invention. In the illustrated embodiment, the motor 28 is disposed on one housing half 24. On the opposite side of the fan housing 20, an air suction opening 48 taking the form of an inflow nozzle 50 is provided.

According to the invention, the fan housing 20 is designed such that it has an air outlet 52 that widens like a snail shell towards the outflow side of the fan, the aperture of the air outlet 52 lying on a plane that extends in a substantially radial manner to the fan housing 20. The air outlet 52 is coupled to a connecting pipe 54 that is used to connect a venturi device 56. The venturi device 56 illustrated in FIG. 3 comprises a venturi mixing tube 59 and a gas inlet 60, the details of the venturi device 56 not being a subject matter of the invention. The venturi device 56 is connected to a burner (not illustrated) by means of a flange 62 and a seal 64. In the embodiment illustrated in FIG. 3, a damping sleeve 58 is connected to the connecting pipe 54 by means of a bayonet connection. The venturi device 56 is coupled to the damping sleeve 58 via a locking plug-in connector, it being understood that these types of connections are only to be taken as examples. The damping sleeve 58 is used on the one hand to secure the fan in various positions and on the other hand to dampen the transmission of vibrations and sound. The damping sleeve may be made of plastics, rubber, metal or any other material, the choice of material essentially determining the damping properties.

In the vicinity of the aperture of the air outlet 52 of the fan, a pressure reference point 46 is formed by an opening in the region of the air outlet. The pressure reference point is used to extract a reference pressure in order to influence the gas supply.

The fan housing 20 and the impeller 26 are preferably made of plastics, most preferably they are made of a plurality of injection molded plastic parts. This results in a low-cost, light-weight design allowing the fan according to the invention to be connected to the venturi device 56 in various positions, depending on the space situation in the burner housing (not illustrated). All in all, an extremely compact design is produced that can be easily integrated into various burner systems. Compared to known fans for gas burner systems, the fan according to the invention achieves a significantly higher power density.

FIGS. 4 to 6 show various views of the fan of FIG. 3, in partial sectional views. Corresponding components are indicated by the same reference numbers. Reference is made to the description of FIG. 3.

In the embodiment of FIG. 6, it can be seen that the impeller 26 has a synchronously rotating impeller cover 44 that is fixedly connected to the impeller 26.

FIG. 7 shows an alternative embodiment of the fan according to the invention in a similar view as the one shown in FIG. 6. In the embodiment of FIG. 7, the impeller 26 does not have its own synchronously rotating cover. The cover for the impeller 26 in this embodiment is formed by the fan housing itself, particularly by the shape of housing half 22. The embodiments of the impeller with a synchronously rotating cover and without a cover, where the cover is formed by the fan housing, are seen comparable from a fluidic point of view. In the embodiment of FIG. 6 in which the impeller 26 has an impeller cover 44, a labyrinth seal (not illustrated) can be provided between the impeller cover and the fan housing, so as to prevent or at least significantly reduce a backflow of air on the side of the impeller facing the air inlet.

The impeller of FIG. 7 is shown again in FIG. 8 in a perspective view.

In FIGS. 9 to 11, an impeller having a synchronously rotating cover (see FIG. 6) is shown again in a perspective view, in a side view and in an exploded view respectively. As can be seen from FIGS. 8 to 10, the impeller wheel 26 comprises the actual impeller 66 as well as the synchronously rotating impeller cover 68 that is tightly enclosed by the fan housing 20. The impeller 66 and the impeller cover 68 can engage in one another using a mortise and tenon connection.

In FIGS. 12 and 13, the impeller 66 again is shown in further detail in a partial sectional view and bottom view. The following remarks on these figures apply to both impellers having a synchronously rotating impeller cover as well as for those impellers in which the fan housing forms the cover. The impeller 66 comprises a hub 70 that carries the impeller blades or impeller wheel at its circumference. Pockets 74, 76 to receive balance weights are formed in the region of the hub 70. These balancing pockets 74, 76 are located on two levels at the circumference of the hub and are both accessible from the same side of the impeller 66. Moreover, they are located outside the air flow region of the impeller so that they do not impair the air passage cross-section of the impeller and no noise can be created by these pockets. The balancing pockets 74, 76 are preferably injection molded to the bottom of the hub 70. Providing the balancing pockets on the bottom of the hub is particularly advantageous in that the bottom of the hub is a region of no importance to the air flow. All in all, this results in a particularly simple and an easy to assemble impeller-design of the fan according to the invention, which does not hold any risk of noise development.

The characteristics revealed in the above description, the claims and the figures can be important for the realization of the invention in its various embodiments both individually and in any combination whatsoever.

We claim:

1. A feeding device for a gas burner system including a fan and a venturi device for feeding combustion gas at the outflow side of the fan in order to form a flammable mixture of gas and air, the fan comprising:

a spiral-shaped fan housing having a rotational axis and an air outlet, the air outlet of the fan housing widening like a snail shell towards the outflow side of the fan, an impeller that is disposed concentric to the rotational axis at the inside of the fan housing, wherein the air outlet of the fan housing is connected to the venturi device.

2. A feeding device according to claim 1, wherein an aperture of the air outlet lies on a plane that extends in a substantially radial manner to the fan housing.

3. A feeding device according to claim 2, wherein the aperture of the air outlet lies on a plane that lies outside the plane of the fan housing.

4. A feeding device according to claim 3, wherein a drain opening is provided in the air outlet channel for a reference pressure.

5. A feeding device according to claim 2, wherein the fan housing is made of plastics.

6. A feeding device according to claim 2, wherein the fan housing is made up of one or more injection molded plastic parts without the use of anti-static material.

7. A feeding device according to claim 1, wherein an aperture of the air outlet lies on a plane that lies outside the plane of the fan housing.

8. A feeding device according to claim 1, wherein the fan housing is made of plastics.

9. A fan according to claim 1, wherein the impeller is made of plastics.

10. A fan according to claim 1, wherein pockets to receive balance weights are integrated in the impeller.

11. A feeding device according to claim 1, wherein a drain opening is provided in the air outlet channel for a reference pressure.

12. A feeding device according to claim 1, wherein a damping sleeve is provided between an aperture of the fan housing and the venturi device, the damping sleeve fixing and sealing the fan housing to the venturi device and dampening the transmission of vibrations.

13. A feeding device according to claim 1 further comprising an electric motor to drive the impeller which is integrated at the center of the impeller.

14. A feeding device according to claim 13, further comprising motor electronics and a full encapsulation of the motor electronics against environmental influences.

15. A feeding device according to claim 13, further comprising a full encapsulation of the electric motor against environmental influences.

* * * * *